US011844982B1

(12) United States Patent
Menq

(10) Patent No.: US 11,844,982 B1
(45) Date of Patent: Dec. 19, 2023

(54) SWIMMING GOGGLES WITH TOP ANCHOR

(71) Applicant: Farnyuh Michael Menq, Austin, TX (US)

(72) Inventor: Farnyuh Michael Menq, Austin, TX (US)

( * ) Notice: Subject to any disclaimer, the term of this patent is extended or adjusted under 35 U.S.C. 154(b) by 0 days.

(21) Appl. No.: 17/863,505

(22) Filed: Jul. 13, 2022

(51) Int. Cl.
*A63B 33/00* (2006.01)

(52) U.S. Cl.
CPC ..... *A63B 33/002* (2013.01)

(58) Field of Classification Search
CPC ... A63B 33/002; A63B 33/004; A63B 33/006; A63B 33/008; B63C 2011/128; B63C 11/12; A61F 9/027; A61F 9/02; A61F 9/026; G02B 23/125; G02C 3/003; G02C 3/02
USPC ..... 2/452, 440, 442; 351/156, 155; 359/409
See application file for complete search history.

(56) References Cited

U.S. PATENT DOCUMENTS 1,118,719 A * 11/1914 Wirth ..... G02C 3/003 2/452
2,126,697 A * 8/1938 Bigelow ..... G02C 9/02 2/453
2,206,997 A * 7/1940 Austad ..... A61F 9/026 2/9
2,504,524 A * 4/1950 Hayward ..... G02C 3/003 2/452
3,531,187 A * 9/1970 Brown ..... A61B 3/04 351/227
D390,582 S * 2/1998 Palmer ..... G06F 1/203 D16/136
6,138,287 A * 10/2000 Chou ..... A63B 33/004 2/440
6,321,391 B1 * 11/2001 Basso ..... A61F 9/027 2/452
8,152,298 B2 * 4/2012 Frank ..... G02C 3/003 351/158
8,448,267 B2 * 5/2013 Hahn ..... A63B 33/004 2/452
2005/0111097 A1 * 5/2005 Iannarelli ..... G02B 25/004 359/407
2009/0049585 A1 * 2/2009 Borsa ..... A42B 3/185 2/10
2009/0113608 A1 * 5/2009 Chou ..... A63B 33/002 2/452

(Continued)

FOREIGN PATENT DOCUMENTS

CN 201832359 U 5/2011
WO WO-2015090166 A1 * 6/2015 ..... A63B 33/002

*Primary Examiner* — Amy Vanatta

(57) ABSTRACT

Swimming goggles includes a main body and a top anchor. The main body includes a lens unit, at least one gasket, and a strap. The at least one gasket is made of soft material and is disposed on a rear side of the lens unit for abutting a face of a wearer. The strap is coupled with the lens unit. A top anchor disposed on top of the main body. The top anchor includes a front end connected to the top portion of the lens unit and extends upward and rearward. Top anchor is configured to abut an upper portion and a rear portion of a head of the wearer wearing the swimming goggles. Thus, the swimming goggles can withstand the water resistance to improve the wearing stability while preventing water leakage into the swimming goggles.

5 Claims, 6 Drawing Sheets

Fig.1A

(56) References Cited

U.S. PATENT DOCUMENTS

| | | | | |
|---|---|---|---|---|
| 2023/0040478 | A1* | 2/2023 | Chen | G02B 27/027 |
| 2023/0152594 | A1* | 5/2023 | Davidson | G06F 1/203 359/601 |

* cited by examiner

SWIMMING GOGGLES WITH TOP ANCHOR

BACKGROUND OF THE INVENTION

The present invention relates to swimming goggles with a top anchor and, more particularly, to swimming goggles with an anchor disposed on a top portion thereof.

A pair of conventional swimming goggles contains two lenses to cover the eyes, two gaskets for cushion and water seal, a nose bridge to connect the two lenses, a strap to hold the goggles in place, and a frame to connect the lenses and the nose bridge. When a swimmer dives into a pool or pushes off a wall of the pool, the swimming goggles are pushed downward away from the top of the swimmer's head due to the resistance of the water. This downward force can cause the swimming goggles to rotate outward away from the swimmer's face or to slide downward, leading to leakage of water into the goggles. Traditionally, the downward force is reduced by lowering the profile of the lenses. To lower the profile, both the volume inside the lenses and the thickness of the gaskets are reduced. This often results in discomfort and indentations of the swimming goggles around the swimmer's eyes. In addition, swimmers often tighten the strap excessively to prevent the swimming goggles from leaking, which furthers the discomfort and indentations.

CN 201832359 discloses swimming goggles with a goggle-fixing-piece attached to the gaskets of the swimming goggles. Both the goggle-fixing-piece and the gaskets are made of the same silicone material. The goggle-fixing-piece is designed to cover a portion of a user's head above the swimming goggles. The top edge of the goggle-fixing-piece is placed underneath a swimming cap. A swimming cap is required and is used to hold the goggle-fixing-piece in place. When the user does not wear the swim cap, the goggle-fixing-piece is not functional, providing poor applications.

Furthermore, as the goggle-fixing-piece is attached to the gaskets of the goggles, it is placed close to the swimmer's face. Such a design provides limited moment arm in preventing the swimming goggles from rotating outward. As a result, it is not effective in preventing the goggles from rotating outward away from the swimmer's face. In addition, the goggle-fixing-piece is apt to deform when subjected to force. Because the goggle-fixing-piece is attached to the gaskets, the deformed goggle-fixing-piece can stress the gasket and compromise the sealing of the gaskets.

Another issue with this design is that it used a single goggle-fixing-piece to connect two lenses. Therefore, the width of the goggles is not adjustable. Various sizes of nose pieces are often provided to users to adjust the width of the goggles. In this design, using a different size of nose piece will require a difference size of goggle-fixing-piece.

BRIEF SUMMARY OF THE INVENTION

An objective of the present invention is to provide swimming goggles with a structure for improving the wearing stability.

Swimming goggles according to the present invention comprises a main body and a top anchor. The main body includes a lens unit, at least one gasket, and a strap. The at least one gasket is made of soft material and is attached on the lens unit for abutting the face of a wearer. The strap is coupled with the lens unit. A top anchor disposed on top of the main body. The top anchor includes a front end connected to a top portion of the lens unit and extends upward and rearward. Top anchor is configured to abut an upper portion and a rear portion of the head of the wearer wearing the swimming goggles.

In an example, the top anchor includes a rear end connected to the strap.

In an example, the strap includes at least one coupling hole configured to couple with the rear end of the top anchor and located behind the head of the wearer wearing the swimming goggles.

In an example, the at least one coupling hole of the strap includes an upper coupling hole and a lower coupling hole. A partitioning portion is disposed between the upper coupling hole and the lower coupling hole. The partitioning portion of the strap includes a surface having at least one first tooth disposed in a vertical direction. The rear end of the top anchor includes a surface having a second tooth configured for coupling with the at least one first tooth.

In an example, the swimming goggles further comprises an adjusting device configured to connect the top anchor with the strap.

In an example, the rear end of the top anchor is pressed by the strap.

When a wearer wears the swimming goggles according to the present invention, the top anchor abuts the upper portion and the rear portion of the head of the wearer to provide the main body with improved resistance to shifting, which can resist the downward push from water resistance to thereby prevent the swimming goggles from rotating outward away from the swimmer's face or sliding downward. Hence, displacement of the swimming goggles can be avoided. As a result, water seal can be achieved with less tightening force of the strap, and the wearing stability can be enhanced. Furthermore, the top anchor can cooperate with the strap for wearing, further preventing shifting of the main body of the swimming goggles, providing improved stability. The top anchor of the present invention can also be made of relatively stiff materials, so it can provide some resistance against upward force.

The present invention will become clearer in light of the following detailed description of illustrative embodiments of this invention described in connection with the drawings.

DESCRIPTION OF THE DRAWINGS

FIG. 1A is an enlarged view of a circled area of FIG. 1

DETAILED DESCRIPTION OF THE INVENTION

Figure 1:
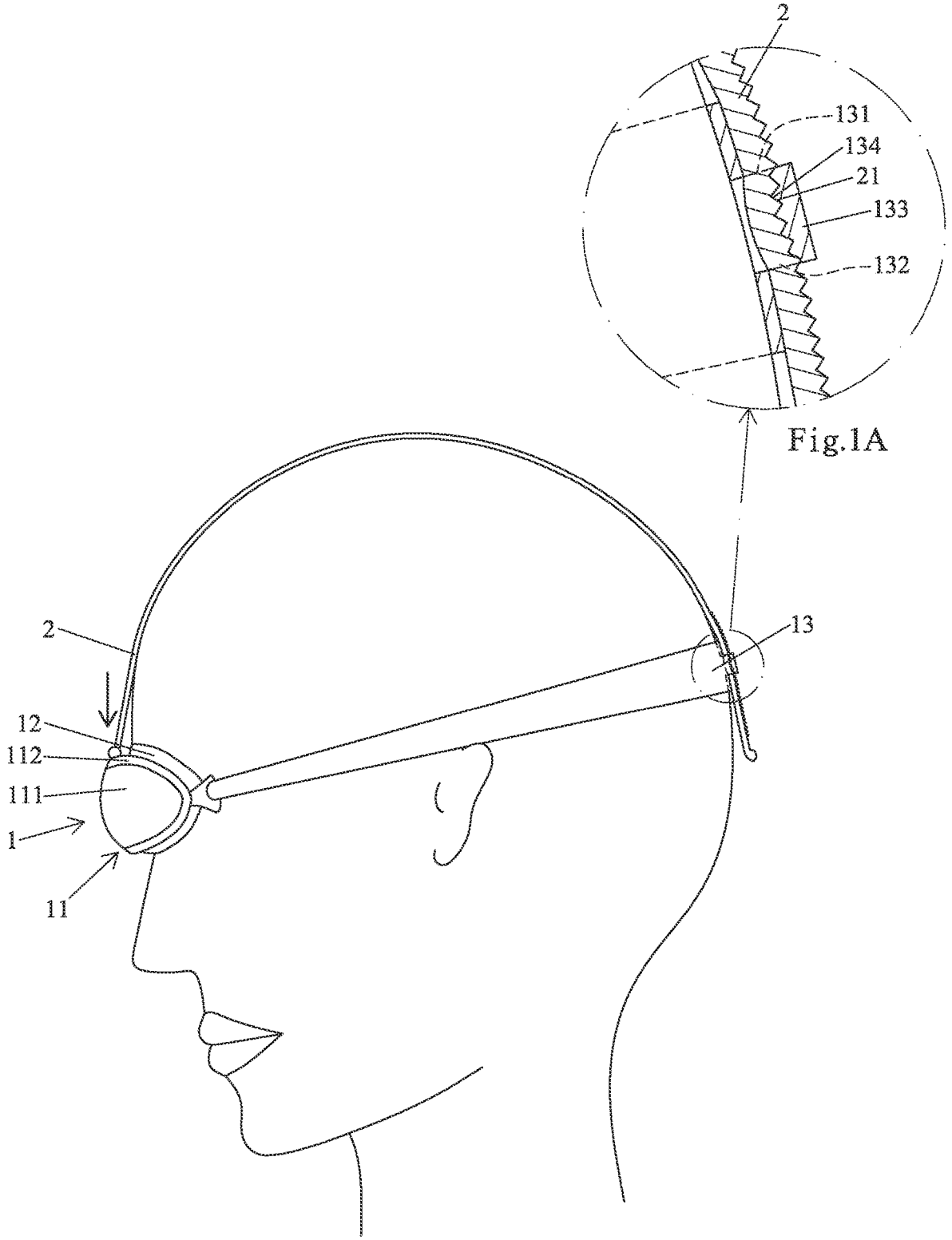
FIG. 1 is a diagrammatic side view illustrating a swimmer wearing swimming goggles with a top anchor of a first embodiment according to the present invention.
Figure 2:
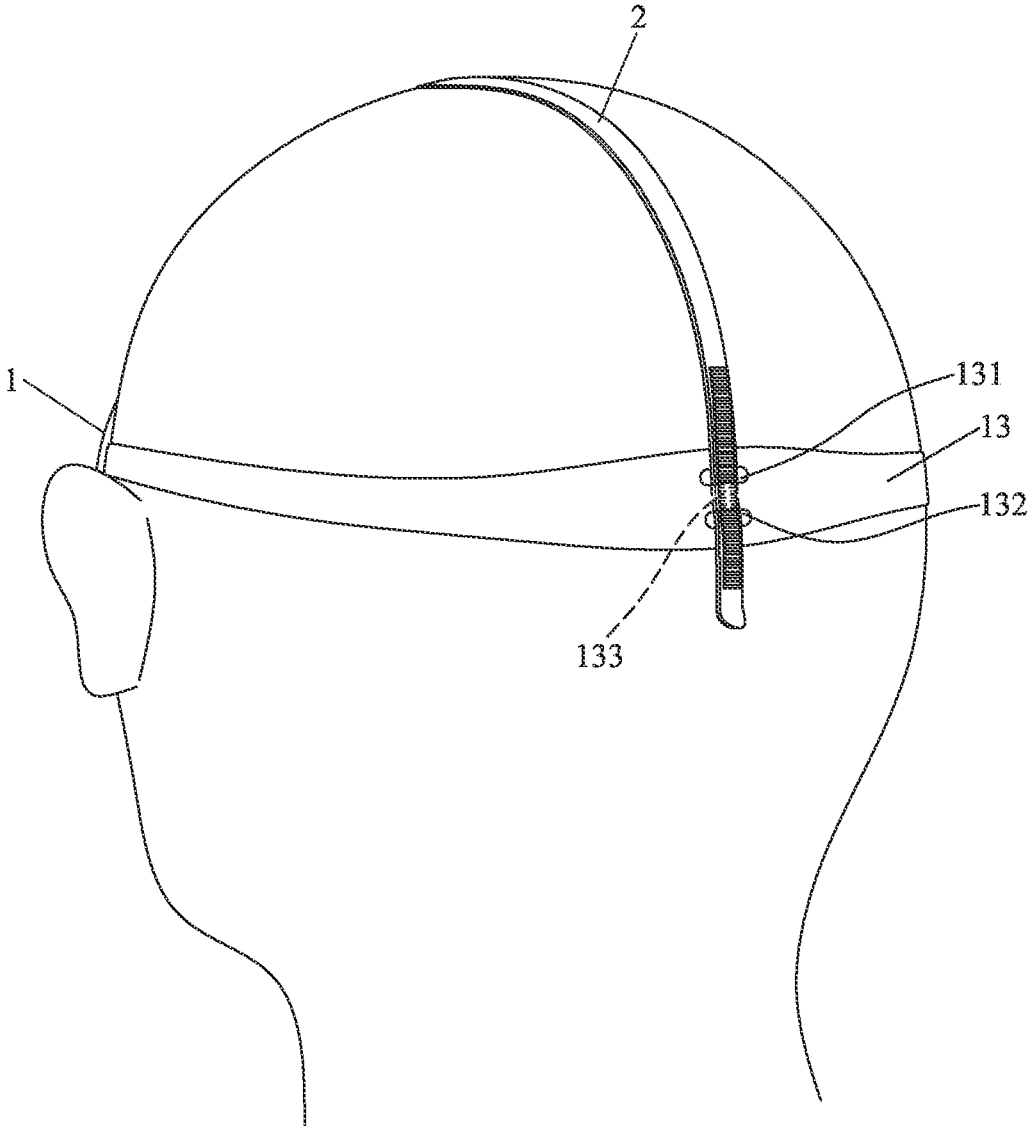
FIG. 2 is a diagrammatic rear view illustrating the swimmer wearing the swimming goggles with the top anchor of the first embodiment according to the present invention.
Figure 3:
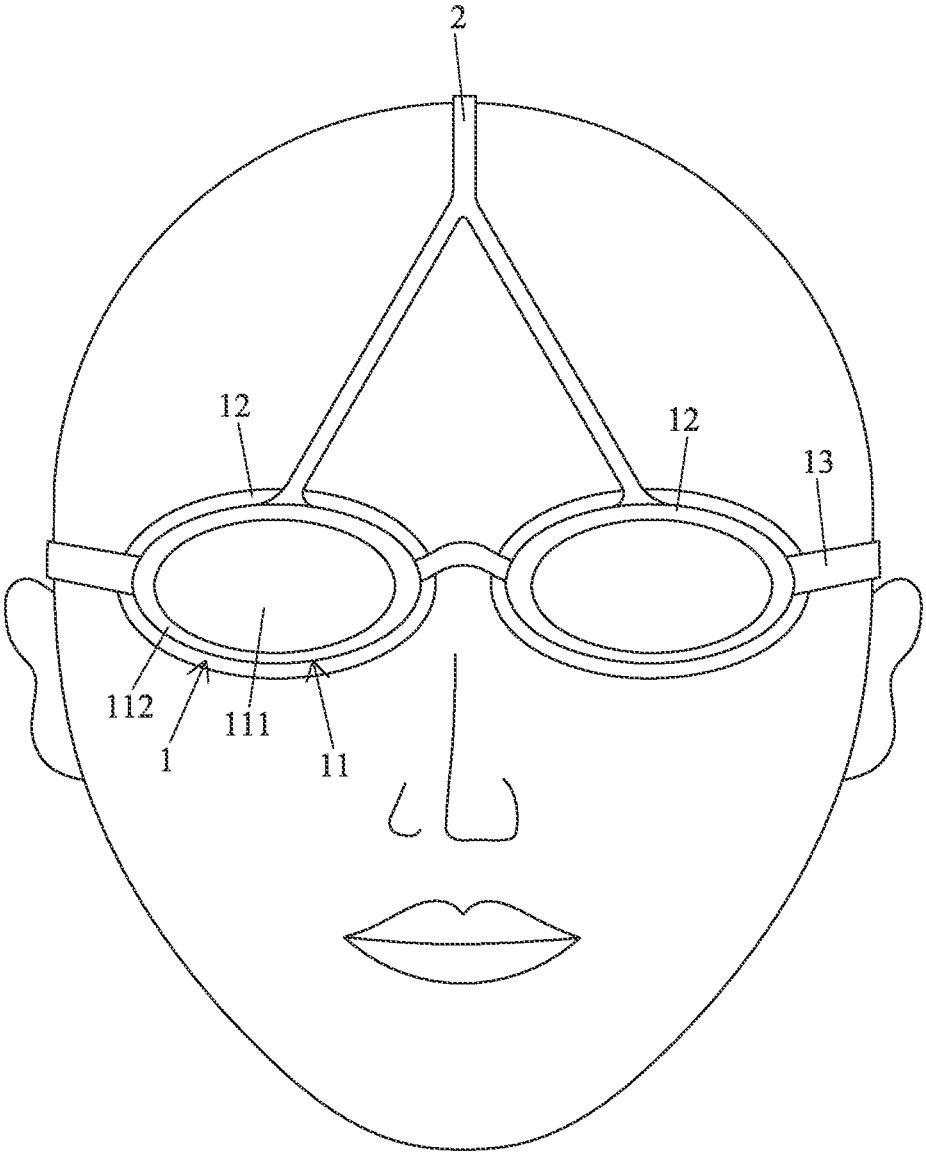
FIG. 3 is a diagrammatic front view illustrating the swimmer wearing the swimming goggles with the top anchor of the first embodiment according to the present invention.

Like reference numerals designate like elements in the embodiments described hereinafter. FIGS. 1-3 illustrate a side view, a rear view, and a front view of a swimmer wearing swimming goggles of a first embodiment according to the present invention. The swimming goggles according to the present invention comprises a main body 1 and a top anchor 2. The main body 1 includes a lens unit 11, two gaskets 12, and a strap 13. The lens unit 11 of this embodiment includes two rigid lenses 111 and a frame 112. The two lenses 111 are coupled with the frame 112. The two gaskets 12 are made of soft material and are coupled with rear sides of the two lenses 111. During wearing, the two gaskets 12 abut a face of the wearer to improve the wearing comfort. The strap 13 is assembled with the frame 112 and can be wound around the head of the wearer to wear the swimming goggles on the head of the wearer. The strap 13 includes coupling holes configured to couple with a rear end of the top anchor 2 and located behind the head of the wearer wearing the swimming goggles. The coupling holes includes an upper coupling hole 131 and a lower coupling hole 132. A partitioning portion 133 is disposed between the upper coupling hole 131 and the lower coupling hole 132. The partitioning portion 133 includes a surface having a plurality of first teeth 134.

The top anchor 2 has little or no deformation while withstanding the water resistance. The rear end of the top anchor 2 includes a surface having a second tooth 21 configured for coupling with the plurality of first teeth 134. The top anchor 2 may be made of a material with a suitable rigidity and may be made of a single material or a composite material. Furthermore, the top anchor 2 may include a core and an outer coating (made of a material softer than the core) around the core (not shown). Thus, the top anchor 2 can have a proper strength and touch feeling. The top anchor 2 that can be made by using stiff materials also provides resistance against downward and upward force.

As shown in FIG. 3, the front portion of the top anchor 2 is bifurcated into two branches each having a distal end. The distal ends of the two branches are respectively connected to the frame 112 near the outer edge of the two lenses 111. The two distal ends of the top anchor 2 extend upward and rearward and merge. In the embodiment shown in FIG. 1, the front end of the top anchor 2 is connected to the top portion of the frame 112. In another embodiment, the top anchor 2 can be connected to the two lenses (not shown). The lens unit can include only lenses but without a frame (not shown).

In this embodiment, the length of the top anchor 2 can surround the top portion and the rear portion of the head of the wearer. The rear end of the top anchor 2 extends through and couples with the upper coupling hole 131 and the lower coupling hole 132. Furthermore, the length of the top anchor 2 may be adjusted according to the contour of the head of the wearer, such that the main body 1 can be stably worn on the face of the wearer. After adjustment, the first teeth 134 can mesh with the second tooth 21 to provide improved positioning stability.

When a swimmer wears the swimming goggles according to the present invention, the top anchor 2 provides excellent supporting strength and abuts the upper portion and the rear portion of the head of the wearer. The rear end of the top anchor 2 of this embodiment is connected to the strap 13 which further secures the top anchor 2 in place, so there is no need of a swimming cap. When the swimmer dives into a pool or pushes from a wall of the pool, the water resistance pushes the swimming goggles downward, and the force imparted to the main body 1 is transmitted to the top anchor 2. This force is then transmitted by the top anchor 2 to the upper portion and the rear portion of the head of the swimmer along a curved path, and the head withstands the force. Thus, the top anchor 2 holds the main body 1 in place while the main body 1 withstands the downward force and prevent the main body 1 from downward displacement or rotation, thereby avoiding water leakage while improving the wearing stability.

According to the present invention, the front end of the top anchor 2 can be connected to or disconnected from the frame 112. The top anchor 2 can be removed in circumstances other than diving.

Figure 4:
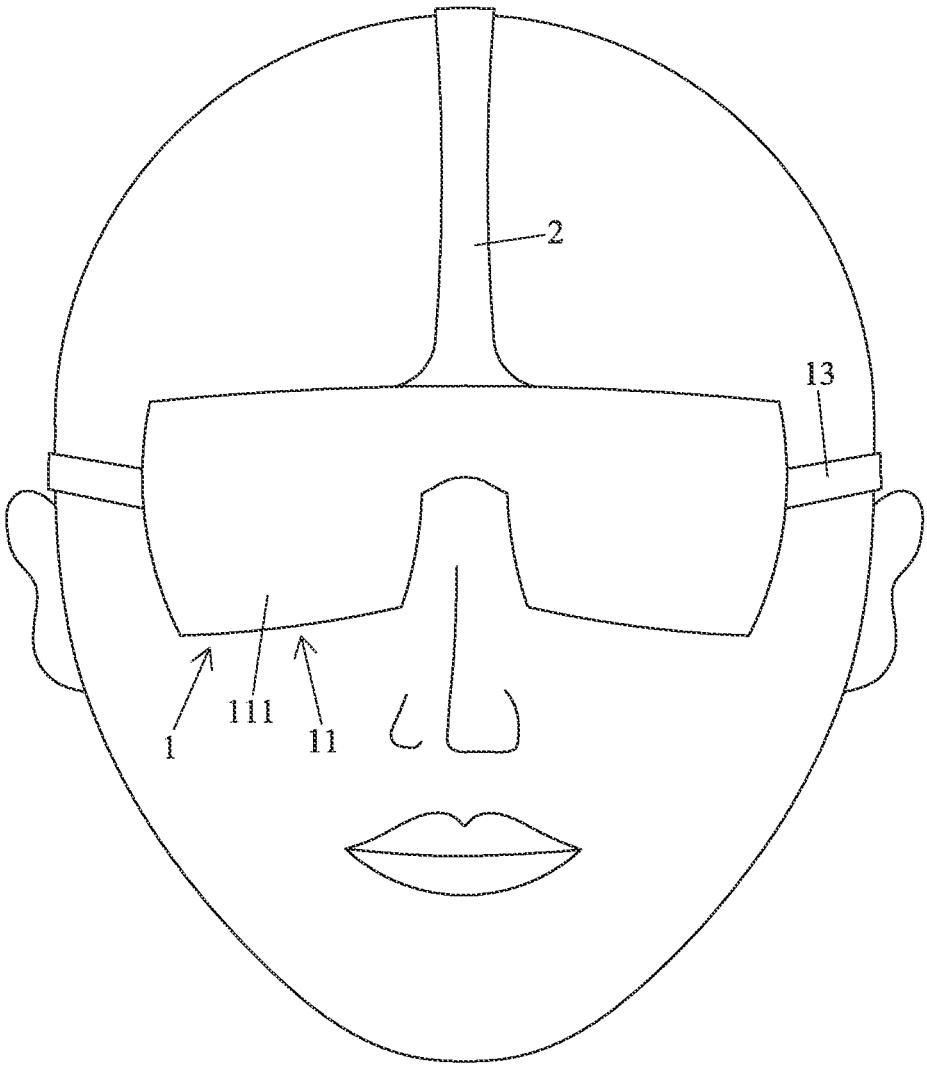
FIG. 4 is a diagrammatic front view illustrating a swimmer wearing swimming goggles with a top anchor of a second embodiment according to the present invention.

FIG. 4 shows swimming goggle of a second embodiment according to the present invention. The second embodiment is substantially the same as the first embodiment except for the lens unit 11 of the main body 1 includes an integral lens 111. Furthermore, the top anchor 2 is connected to a central, upper portion of the lens 111. The present invention may be utilized in various types of main body 1.

Figure 5:
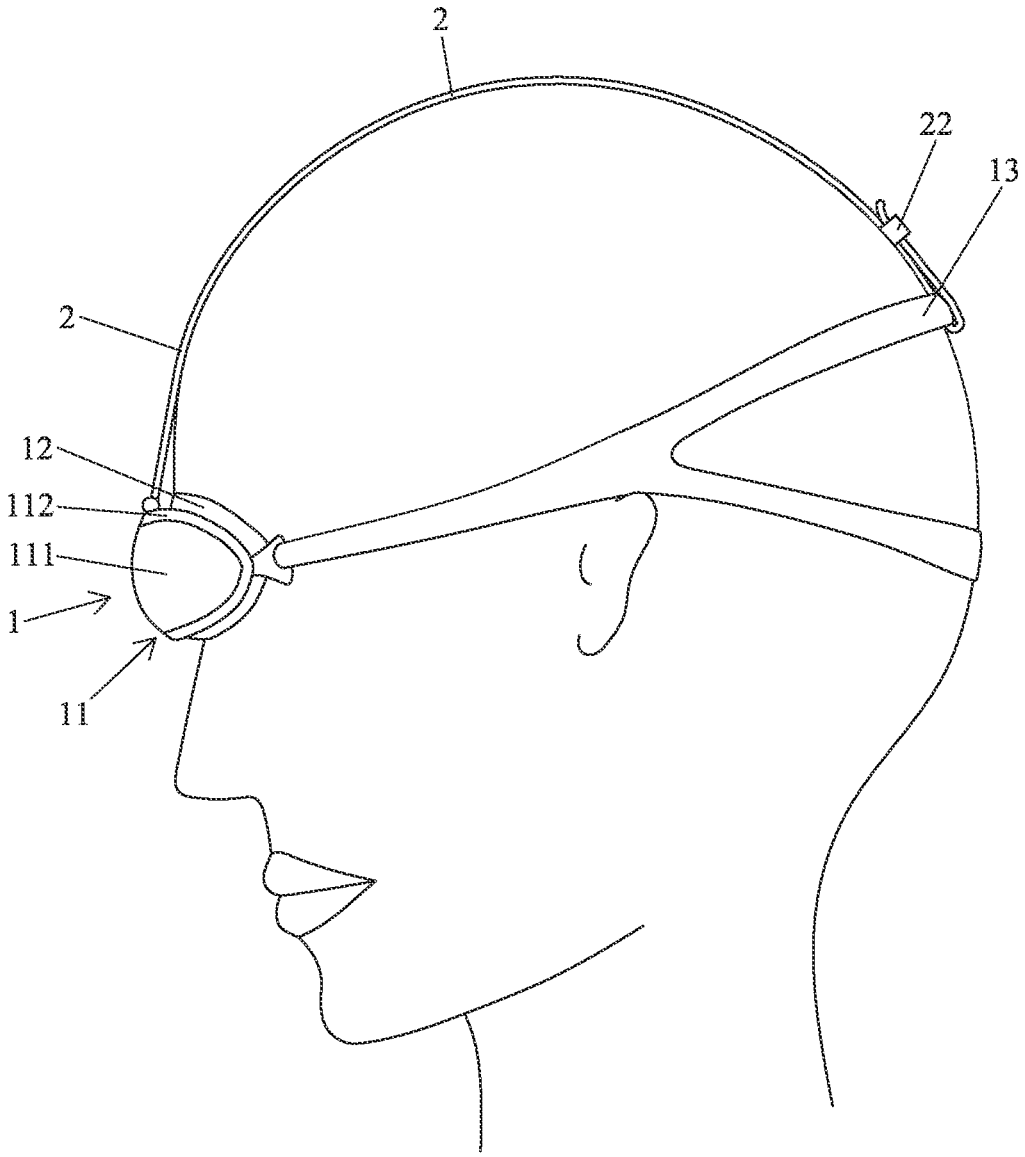
FIG. 5 is a diagrammatic side view illustrating a swimmer wearing swimming goggles with a top anchor of a third embodiment according to the present invention.

FIG. 5 shows swimming goggle of a third embodiment according to the present invention. The third embodiment is substantially the same as the first embodiment except for an adjusting device 22 is disposed on the rear end of the top anchor 2 for connecting the top anchor 2 with the strap 13 behind the rear portion of the head of the wearer while permitting adjustment of the length of the top anchor 2. The adjusting device of this embodiment is a holding loop. The rear end of the top anchor 2 is wound around the strap 13 and folded backward and is held in place by the adjusting device 22. The length of the top anchor 2 can be adjusted according to the contour of the head of the wearer, such that the main body 1 can be stably worn on the head of the wearer. The top anchor 2 of this embodiment is connected to the strap 13, such that the strap 13 assures the top anchor 2 can more stably support the main body 1 to withstand the water flow without occurrence of downward shift or rotation and to avoid water leakage.

Figure 6:
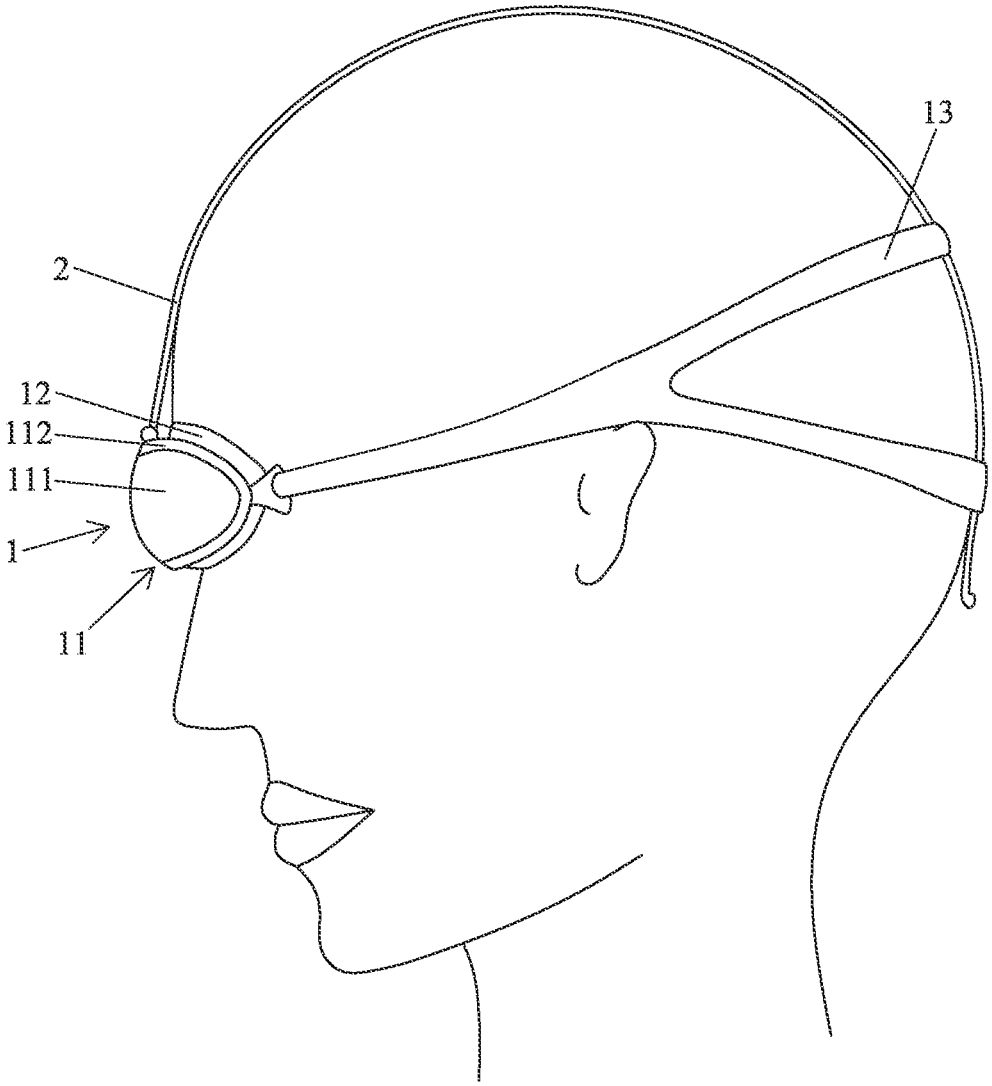
FIG. 6 is a diagrammatic side view illustrating a swimmer wearing swimming goggles with a top anchor of a fourth embodiment according to the present invention.

FIG. 6 shows swimming goggle of a fourth embodiment according to the present invention. The fourth embodiment is substantially the same as the first embodiment except for that the rear end of the top anchor 2 is located below and pressed by the strap 13. The swimmer can pull the rear end of the top anchor 2 downward to adjust the wearing comfort. Furthermore, the pressing force of the strap 13 permits the top anchor 2 to stretch the main body 1 while the main body 1 withstands the downward force. The top anchor 2 can resist the water flow impact to prevent the main body 1 from downward displacement or rotation.

In view of the foregoing, the top anchor 2 according to the present invention can withstand the downward pushing force acting on the swimming goggles. The top anchor 2 provides better stability and ease of use than conventional arrangements requiring coupling with the swim cap.

Although specific embodiments have been illustrated and described, numerous modifications and variations are still possible without departing from the scope of the invention. The scope of the invention is limited by the accompanying claims.

The invention claimed is:

1. Swimming goggles comprising:

a main body comprising:

a lens unit, at least one gasket made of soft material, the at least one gasket disposed on a rear side of the lens unit for abutting a face of a wearer, a frame, and a strap coupled with the lens unit, wherein the strap has an upper coupling hole, a lower coupling hole, and a partitioning portion between the upper coupling hole and the lower coupling hole, wherein the partitioning portion has a surface having at least one first tooth disposed in a vertical direction; and a top anchor disposed on top of the main body and configured to abut an upper portion and a rear portion of a head of the wearer, wherein the top anchor comprises:

a front end connected to a top portion of the frame and extends upward and rearward; and a rear end connected to the strap at one of the upper coupling hole and the lower coupling hole of the strap, wherein the rear end has a surface with a second tooth configured for coupling with the at least one first tooth of the partitioning portion of the strap.

2. The swimming goggles as claimed in claim 1, wherein the lens unit includes at least one lens, and wherein the front end of the top anchor is connected to a top portion of the at least one lens.

3. The swimming goggles as claimed in claim 1, wherein the lens unit includes at least one lens and a frame, and wherein the front end of the top anchor is connected to a top portion of the frame.

4. The swimming goggles as claimed in claim 1, wherein the top anchor is fixedly or detachably connected to the lens unit.

5. Swimming goggles comprising:

a main body comprising:

a lens unit, wherein the lens unit includes a frame, a first lens, and a second lens, each of the first lens and the second lens having a rear side and a top outer edge;

a first gasket and a second gasket, each gasket made of soft material, the first gasket disposed on the rear side of the first lens for abutting a face of a wearer, the second gasket disposed on the rear side of the second lens for abutting the face of the wearer; and a strap connected to the frame of the lens unit; and a top anchor disposed on top of the main body and configured to abut an upper portion and a rear portion of a head of the wearer, wherein the top anchor comprises a front portion connected to a top portion of the frame, wherein the front portion of the top anchor is bifurcated into two branches each having a distal end, wherein each of the two branches is respectively connected to the frame near the top outer edges of the two lenses, and wherein the distal ends of the two branches extend upward and rearward and merge together.

* * * * *